US005139751A

United States Patent [19]

Mansfield et al.

[11] Patent Number: 5,139,751

[45] Date of Patent: Aug. 18, 1992

[54] APPARATUS FOR THRUSTING A HOSE ALONG A CONDUIT

[75] Inventors: William A. Mansfield, San Mateo; Frank O. Martinez; Steven E. Richardson, both of Freemont, all of Calif.

[73] Assignee: Airrigation Engineering Co., Inc., San Jose, Calif.

[21] Appl. No.: 578,886

[22] Filed: Sep. 7, 1990

[51] Int. Cl.[5] ..... B05B 13/06

[52] U.S. Cl. ..... 422/292; 137/355.12; 137/355.26; 137/355.2; 242/86.5 R; 175/76; 118/306

[58] Field of Search ..... 242/86, 86.5 R, 86.8, 242/54 R; 422/292, 305, 1; 405/154, 156; 137/355.12, 355.2, 355.26, 899; 254/134.3 FT, 134.5; 118/306; 51/411, 429; 175/76

[56] References Cited

U.S. PATENT DOCUMENTS 2,148,982 2/1939 Erikson ..... 254/134.5
3,687,385 8/1972 Skalleberg ..... 242/54 R
3,774,630 11/1973 Prange ..... 137/355.12
3,810,487 5/1974 Cable et al. ..... 137/351
4,066,093 1/1978 Egerstrom ..... 137/355.2
4,454,999 6/1984 Woodruff ..... 242/86.5 R
4,540,017 9/1985 Prange ..... 137/355.12
4,838,302 6/1989 Prange ..... 137/355.12

*Primary Examiner*—Robert J. Warden
*Assistant Examiner*—T. A. Trembley
*Attorney, Agent, or Firm*—Burns, Doane, Swecker & Mathis

[57] ABSTRACT

An apparatus for pushing a hose along a conduit includes a rotatable reel, a hose wound on the reel, and a driving arrangement for drawing the hose off the reel and for pushing the hose into and along a conduit. The apparatus can also include an arrangement attached to a leading end of the hose for permitting the leading end of the hose to roll along the interior surface of the conduit. Also, a guide can be positioned in the access opening to the conduit in order to permit the hose to move more easily through sharp turns.

30 Claims, 4 Drawing Sheets

APPARATUS FOR THRUSTING A HOSE ALONG A CONDUIT

FIELD OF THE INVENTION

The present invention relates to an apparatus and method for thrusting a hose along a conduit. More particularly, the present invention concerns an apparatus and method for thrusting a hose along a conduit in order to permit the interior of the conduit, such as a sewer line, to be treated with a material.

BACKGROUND OF THE INVENTION

Various types of conduits such as those used in underground sewer systems, require occasional treatment for various purposes. For example, it may be necessary to dispense foaming fumigants in the conduit to kill roots or other plant growth, or it may be necessary to apply corrosion retardants, grease removal agents, paint, and other types of material to the inner surface of the conduit.

One method that has been employed for treating the interior of closed conduits such as underground sewer systems involves manually feeding a hose into the closed conduit in the downstream direction and then withdrawing the hose from the conduit in the upstream direction while the material for treating the interior of the conduit is pumped through the hose.

In another method, a tagline is floated downstream behind a parachute or other type of float. The tagline is then used to pull the hose through the conduit. After being pulled to the desired point, the hose is withdrawn while the treatment material is dispensed.

Another method involves a fluid jet which is connected to the leading end of the hose. When the jet is turned on, the force of the jet propels the hose in the direction opposite to the direction in which the jet is pointing. Thereafter, the hose can be withdrawn while the treatment material is applied. However, several problems exist with the aforementioned methods.

By way of example, the access openings or manhole covers to the conduits through which the hose is fed are spaced apart a significant distance from one another, usually at intervals of 250 to 500 feet. The common practice is to treat or apply material to the conduit from one manhole cover to the next. When the hose is forced into the conduit manually, a significant amount of manual labor is required to push the hose through the conduit and then withdraw the hose for application of the treatment material. In addition, manually pushing the hose through the conduit can be quite time consuming.

Another problem concerns the friction build-up that occurs as more and more hose is fed into the conduit. While it may be readily easy to push an initial portion of the hose into the conduit, as more and more hose is fed into the conduit and pushed along the inner surface of the conduit, a frictional force is built up which causes further difficulty in attempting to push the hose the necessary distance between manhole covers.

Additional problems arise when the hose or conduit is manually forced into a conduit containing obstacles, obstructions and/or turns. Rigid pipe is not entirely suitable for use in conduits that contain turns because it is difficult to negotiate the pipe through the turns. Likewise, the use of rigid pipe in conduits that contain obstacles or obstructions such as conduit cracks, conduit offsets, roots, collected debris, and other obstructions presents problems because every time the rigid pipe confronts an obstacle or obstruction, it is often necessary to partially withdraw the pipe in attempt to move the pipe around the obstruction. On the other hand, manually forcing flexible or semi-rigid hose into conduits containing turns, obstructions and/or obstacles presents a different set of problems. When a flexible or semi-rigid hose encounters a turn, an obstacle or obstruction, the hose tends to kink or bow, thereby causing the hose to pile up at the point of obstruction or turn.

Another consideration that arises in the treatment of conduits involves the characteristics of the hose commonly used to treat conduits. Typically, the hose is stored on a reel and when it is necessary to treat a conduit, the hose is unwound from the reel and fed into the conduit. The characteristics of the hose commonly used in the treatment of conduits are such that the hose tends to develop a coiled set or memory due to the initial manufacturing process and the fact that the hose is wound on a reel while still hot from the manufacturing process. Consequently, when the hose is unwound from the reel, the hose tends to maintain its coiled shape due to the set or memory that was imparted to the hose when it was manufactured and wound on the reel. The coiled nature of the hose and particularly, the coiled nature of the leading end of the hose, presents many difficulties in attempting to push the hose into the conduit. For instance, rather than pointing in the direction of movement and moving in response to a pushing force, the hose tends to coil on itself and resist the pushing force. Moreover, frictional forces increase as the coiled hose contacts the wall of the conduit.

The alternative methods mentioned above do not involve pushing the hose or pipe through the conduit and consequently, may be better suited in some respects than the aforementioned manual method. However, those alternative methods of jetting and tagging/parachuting are time consuming and are somewhat complex and expensive.

OBJECTS AND SUMMARY OF THE INVENTION

In view of the foregoing drawbacks and disadvantages, it is an object of the present invention to provide an apparatus and method for feeding pipe or hose into a conduit that do not suffer from many of the drawbacks and disadvantages associated with known apparatus and methods.

It is also an object of the present invention to provide an apparatus and method for feeding pipe or hose into a conduit and for treating the interior of the conduit with a material.

It is also an object of the present invention to provide an apparatus and method for feeding a semi-rigid hose into a conduit that are not susceptible to the problems commonly associated with conduits which have turns, obstacles, and obstructions along their length.

It is another object of the present invention to provide an apparatus and method for feeding a hose along a conduit that do not require significant amounts of manual labor.

It is a further object of the present invention to provide an apparatus and method for feeding a hose along a conduit that are able to compensate for the natural tendency of the semi-rigid hose to coil as it is unwound from the reel.

The foregoing objects as well as additional objects that will become apparent from the description that follows are realized through the apparatus and method of the present invention. According to one aspect, an apparatus for moving a hose along a conduit includes a rotatable reel, a hose wound on the reel, and a driving apparatus for drawing the hose off the reel and for driving the hose into and along a conduit. The apparatus may also include an arrangement connected to a leading end of the hose for rolling the leading end of the hose along the inner surface of the conduit to help prevent the movement of the hose through the conduit from being impeded as a result of obstacles and obstructions in the conduit. The leading end of the hose can be treated to change its memory characteristics and thereby permit the hose to move through the conduit more easily.

According to a further aspect of the present invention, an apparatus for use in treating an interior of a conduit includes a rotatable reel, a hose wound on the reel, a driving arrangement for drawing the hose off the reel and for driving the hose into and along the conduit, an arrangement connected to a leading end of the hose for rolling the leading end of the hose along the interior surface of the conduit to help prevent the movement of the hose through the conduit from being impeded as a result of obstacles and obstructions in the conduit, a container containing a material for treating the interior of the conduit, and an apparatus for pumping the material in the container through the hose to treat the interior of the conduit. In accordance with another aspect of the present invention, a method of conveying a hose into and along a conduit includes the steps of unwinding a hose from a rotatable reel, inserting a leading end of the hose into the conduit and mechanically driving the hose along the conduit. The method may also include the steps of treating a portion of the hose adjacent the leading end prior to inserting the hose into the conduit to change its memory characteristics, rolling the leading end of the hose along the inner surface of the conduit, and conveying the hose through a guide pipe located in an access opening to the conduit in order to more readily guide the hose into the conduit.

According to another aspect of the present invention, a method of treating an interior of a conduit with a material includes the steps of unwinding a hose from a reel, inserting a leading end of the hose into a conduit, mechanically driving the hose along the conduit while the leading end of the hose is rolling along the inner surface of the conduit, and mechanically withdrawing the hose from the conduit while simultaneously pumping a material for treating the interior of the conduit through the hose.

BRIEF DESCRIPTION OF THE DRAWING FIGURES

A full understanding of the present invention will become apparent from the description that follows wherein like elements bear like reference numerals and wherein.

DETAILED DESCRIPTION OF THE PREFERRED EMBODIMENT

Figure 1:
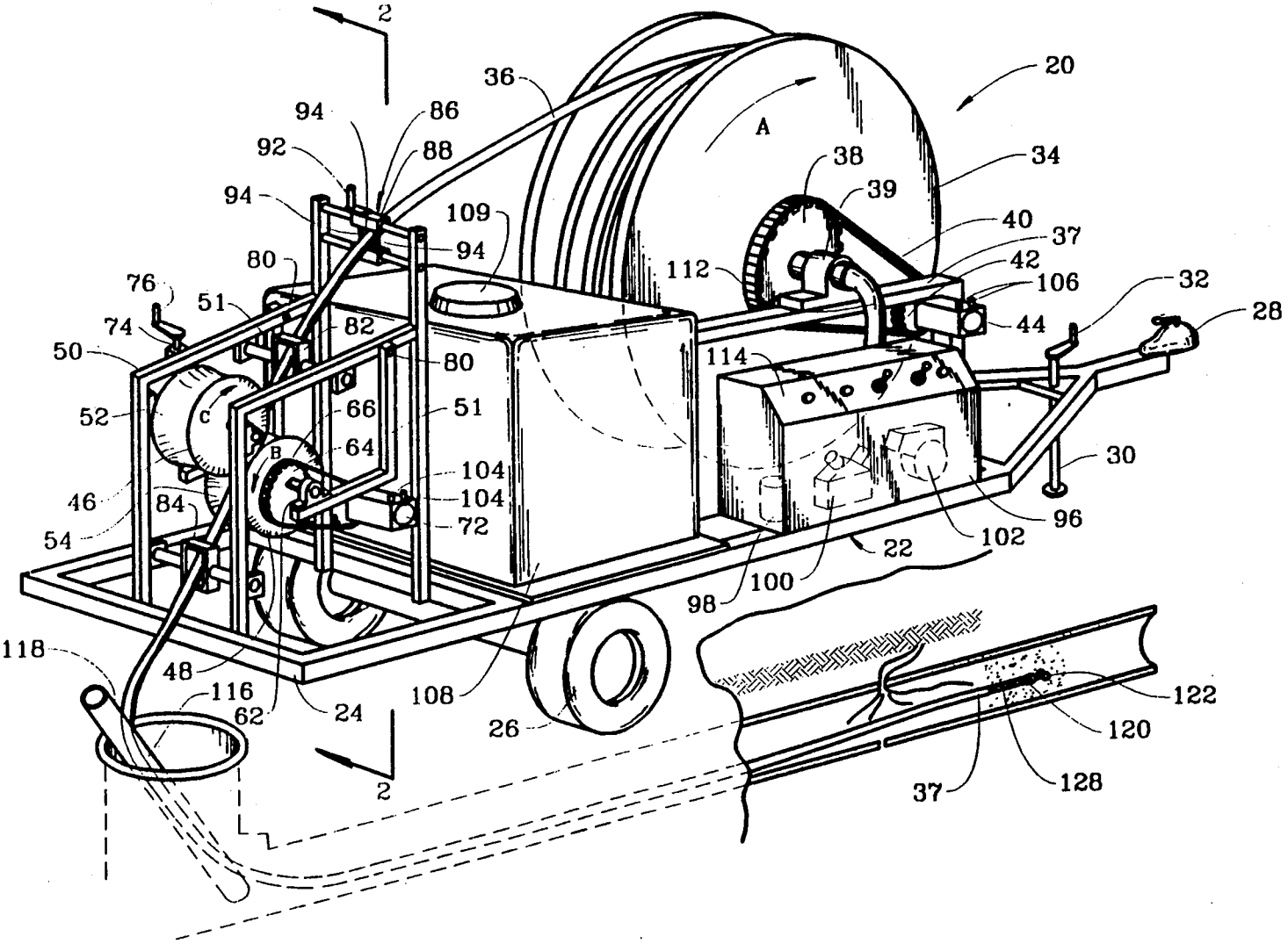
FIG. 1 is a perspective view of the hose thrusting apparatus of the present invention.

The apparatus 20 according to the present invention includes, as seen in FIG. 1, a transport vehicle 22 which may consist of a frame structure 24 which is secured to wheels 26 for easy transport. The transport vehicle 22 may be provided with a suitable hitch 28 at the forward end thereof for attachment to a vehicle of any suitable type in order to permit the transport vehicle 22 to be moved from place to place. The transport vehicle 22 ma also include a support leg 30 for supporting the vehicle when not connected to a truck or the like. Also, a support leg crank 32 may be provided for adjusting the position of the support leg 30.

Figure 3:
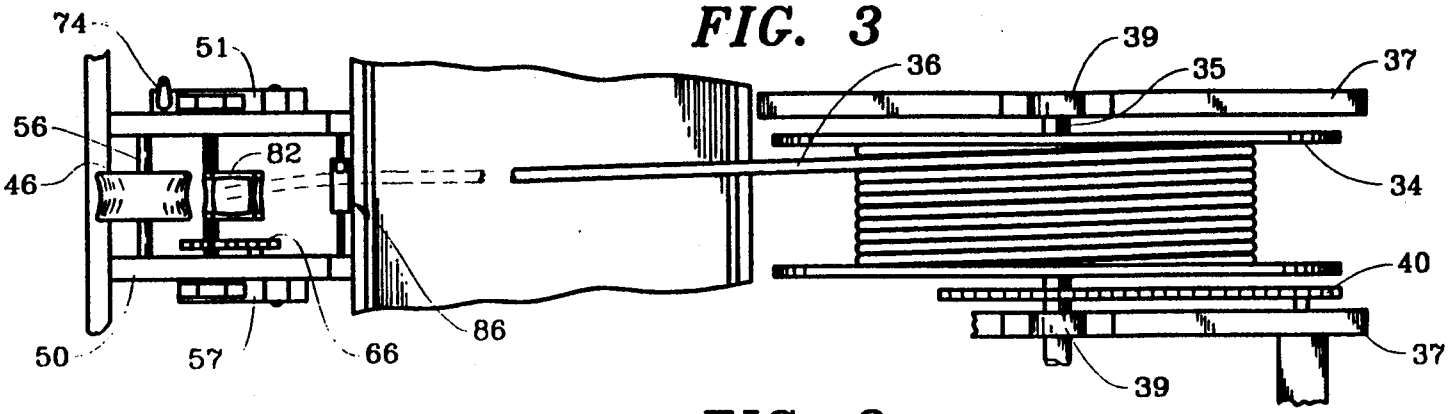
FIG. 3 is a top view of the hose thruster apparatus according to the present invention.

Mounted on a support frame 37 is a rotatable reel 34 on which is wound a hose 36. As seen in FIG. 3, the reel 34 is fixedly connected to an axle 35. The axle 35 is rotatably mounted in bearing-lined holes formed in brackets 39 which are secured to the support members 37. Connected to the axle 35 of the reel 34 is a sprocket 38 around which passes a chain 40. The chain 40 also passes around a smaller sprocket 42. The smaller sprocket 4 is connected to the drive shaft of a suitable hydraulic motor 44. The hydraulic motor 44 is fixedly connected in any suitable manner to the support member 37. Through operation of the hydraulic motor 44, the reel 34 can be rotated in the clockwise direction, represented by arrow A in FIG. 1, to wind the hose 36 onto the reel 34.

Alternative types of motors could be utilized instead of the hydraulic motor 44 to drive the reel 34. For instance, a variable speed motor, a clutch/motor, and a motor capable of forward and reverse operation could be utilized.

At the opposite end of the transport vehicle 22, an arrangement is provided for drawing the hose 36 off the reel 34 and for driving o thrusting the hose 36 into and along the conduit. That arrangement includes two tires or rollers 46, 48. The two tires 46, 48 are preferably pneumatic tires positioned in opposing relation to one another above and below the hose 36. Since the tires 46, 48 are preferably pneumatic, their outer peripheral surfaces 52, 54 tend to take on a concave shape as they are forced into contact with the hose 36. The rollers 46, 48 are preferably formed of rubber or a similar material that is able to positively grip the hose 36.

As an alternative to the pneumatic tires 46, 48, other types of rollers could be utilized. Such rollers could have a concavely shaped outer peripheral surface to provide substantial contact with the hose 36 and to help maintain the hose between the two rollers. Rather than providing the outer peripheral surface of the rollers with a concave shape, a suitable type of guide could be provided at the axial ends of the rollers to maintain the hose between the rollers.

The upper tire or roller 46 is mounted on a support frame 50 by way of a shaft 56. The shaft 56 is received in brackets 58 which are secured to the support frame 50. Preferably, the upper roller 46 is freely rotatable. The free rotation of the upper roller 46 can be accomplished by mounting the upper roller 46 for free rotation on the axle 56 while fixing the shaft 56 to the brackets 58, by mounting the axle 56 for free rotation in the brackets 58 while fixing the upper roller 46 to the shaft 56, or by mounting the axle 56 for free rotation in the brackets while also mounting the upper roller 46 for free rotation on the shaft 56.

Figure 2:
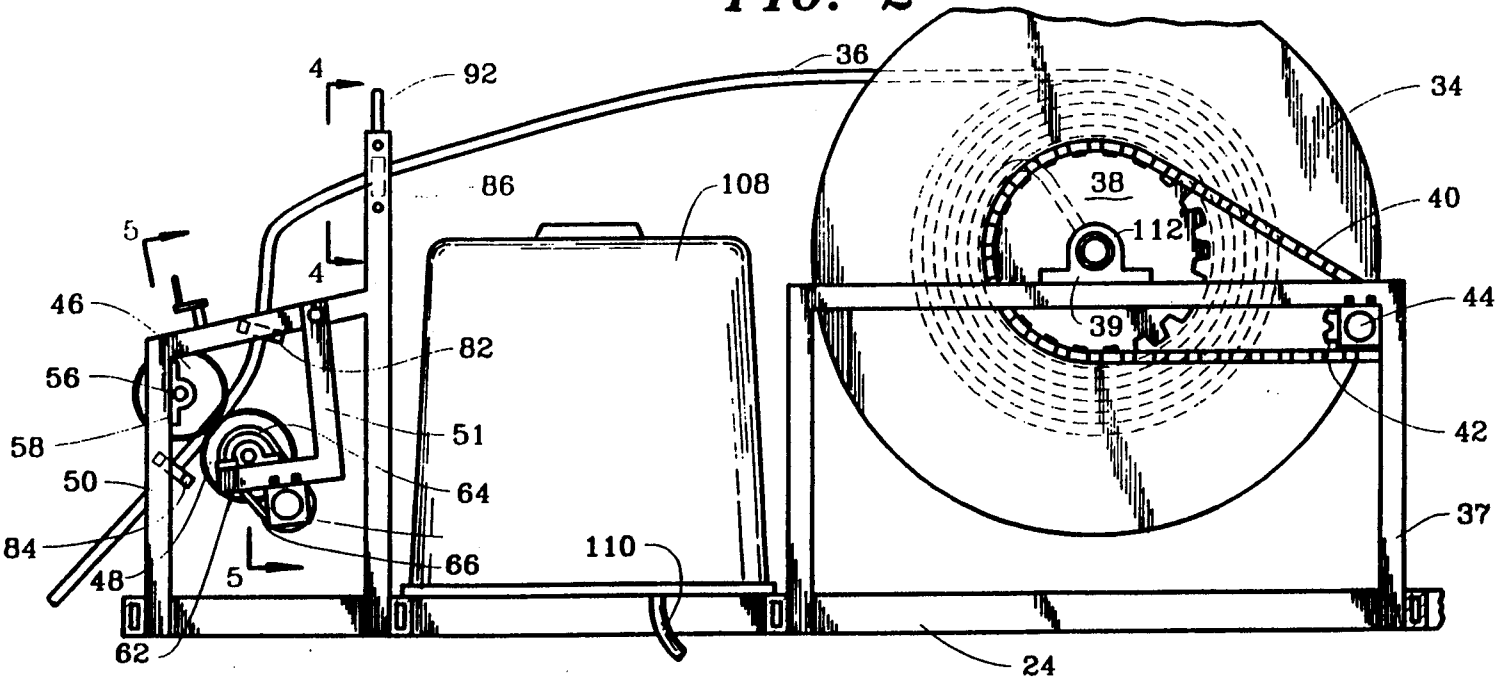
FIG. 2 is a cross-sectional view of the apparatus illustrated in FIG. 1 along the section line 2—2.

The lower tire or roller 48 also includes an axle 60 which is mounted for free rotation in brackets 62 (only one of which is shown in FIGS. 1 and 2). The brackets 62 are secured to arms 51. A sprocket 64 is fixedly secured to the axle 60 of the lower roller 48 and a chain 66 passes around the sprocket 64. The chain 66 also passes around a sprocket 68 which is fixedly secured to the drive shaft 70 of a hydraulic motor 72. The hydraulic motor 72 is mounted on the arm 51.

A motor other than the hydraulic motor 72 could be utilized to drive the lower roller 48. For example, a variable speed motor, a clutch/motor, or a motor capable of forward and reverse operation could be employed.

Through operation of the hydraulic motor 72, the lower roller 48 is rotatably driven in the counterclockwise direction, represented by the arrow B in FIG. 1. The rotation of the lower roller 48 imparts a driving force to the hose 36 and causes the upper roller 46 to rotate in a clockwise direction, represented by the arrow C in FIG. 1. In that way, the hose 36 is drawn off the reel 34 and is driven or thrust in the forward direction into and along the conduit.

Of course, it is to be understood that as an alternative to the arrangement described above, the upper roller 46 could be rotatably driven by a hydraulic motor while the lower roller 48 is mounted for free rotation on the support frame 50. As a further alternative, both of the rollers 46, 48 could be rotatably driven by individual hydraulic motors or both rollers 46, 48 could be rotatably driven by the same hydraulic motor.

Figure 5:
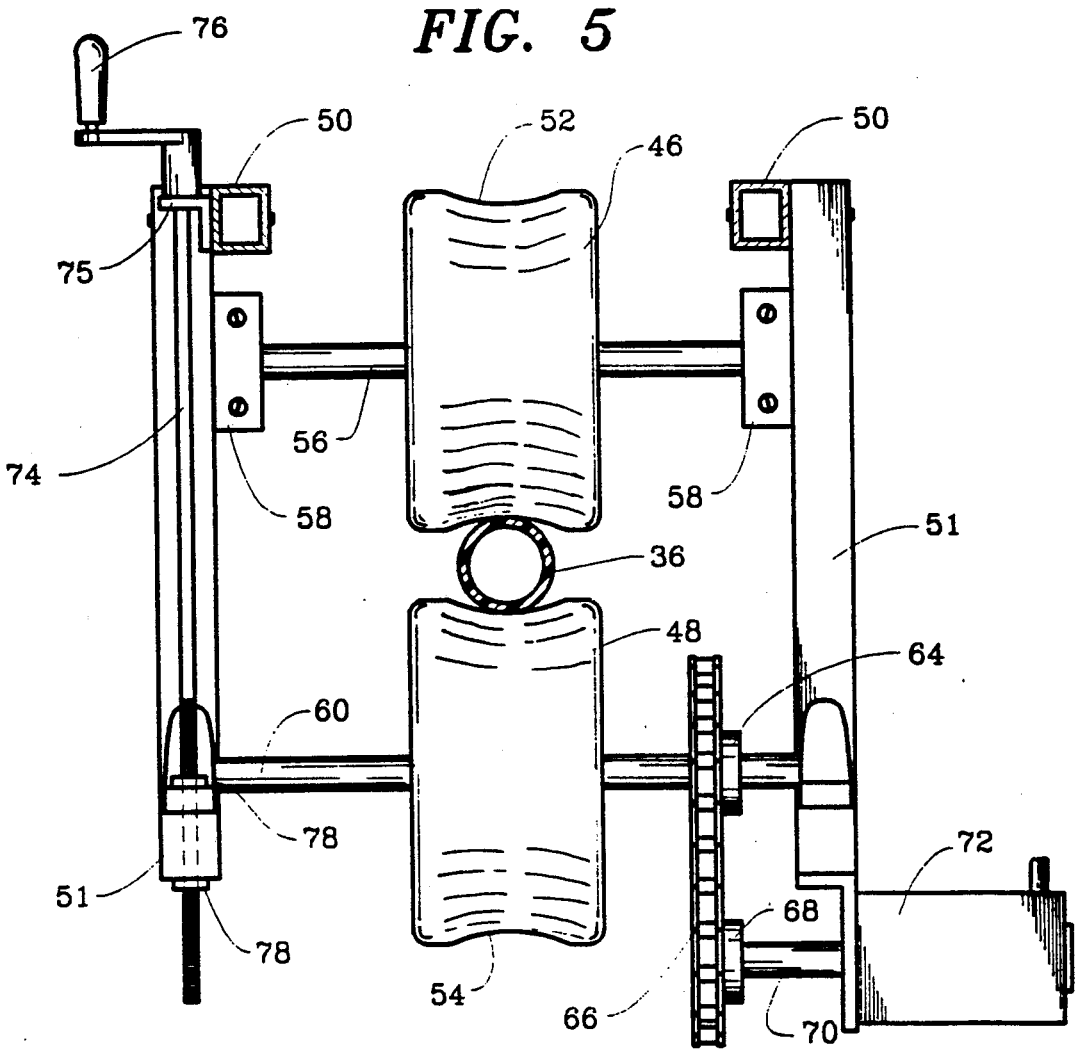
FIG. 5 is a cross-sectional view of a portion of the host thrusting apparatus of the present invention illustrated in FIG. 2 along the section line 5—5.

The apparatus according to the present invention also includes an arrangement for adjusting the position of the lower roller 48 relative to the upper roller 46 in order to vary the force applied to the hose 36. That arrangement is best seen in FIG. 5 and includes a crank 74 mounted on a bracket 75 which is secured to the support frame 50. The crank shaft 74 extends freely through a hole in the arm 50 on which is mounted the lower roller 48. A handle 76 is connected to the crank 74 and nuts 78 are threadably connected to the lower end of the crank shaft on opposite sides of the arm member 51.

The arms 51 are pivotally connected to the support frame 50 in any suitable manner such as through the use of pivot pins 80. By rotating the handle 76 of the crank 74, the arms 51 can be pivoted about the pivot pins 80, thereby causing the lower roller 48 to move towards or away from the upper roller 46, depending upon the direction of rotation of the handle 76. In that way, the force applied to the hose 36 can be varied.

The apparatus of the present invention also includes a guide 82 for guiding the hose 36 between the two rollers 46, 48 when the hose 36 is being drawn off the reel 34 and for guiding the hose 36 toward the reel 34 when the hose is being rewound on the reel 34. Another guide 84 is also provided for guiding the hose 36 away from the rollers 46, 48 when the hose is being drawn off the reel 34 and for guiding the hose toward the rollers 46, 48 when the hose 36 is being rewound. Each of the guides 82, 84 is fixedly mounted to a shaft which is fixedly connected to brackets extending from the support frame 50. Each of the guides 82, 84 may consist of four freely rotatable rollers arranged at right angles to one another in order to permit the hose 36 to move freely through the guides 82, 84.

Figure 4:
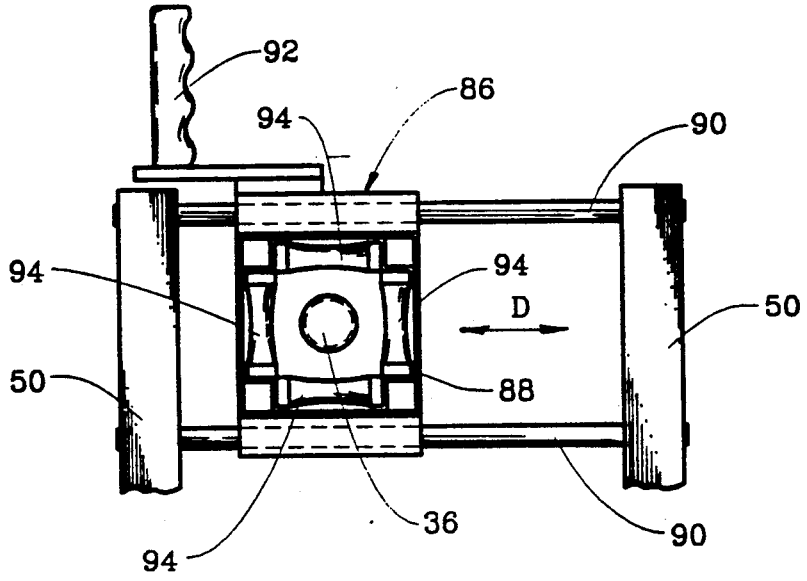
FIG. 4 is a cross-sectional view of a portion of the hose thrusting apparatus of the present invention illustrated in FIG. 2 along with section line 4—4.

The apparatus according to the present invention may also include a guide arrangement 86 for guiding the hose 36 as it is wound onto the reel 34. As clearly illustrated in FIG. 4, the guide arrangement 86 includes a frame member 88 which is slidably mounted on two rods 90 which extend between and are secured to the support frame 50. A handle 92 is connected to the frame member 88. Positioned within the frame member 88 are four freely rotatable rollers 94 arranged substantially at right angles to one another. The freely rotatable roller 94 permits the hose 36 to move freely through the guide arrangement 86.

Through use of the handle 92, the guide arrangement 86 can be slid back and forth in the direction represented by arrow D to ensure that the hose 36 is wound onto the reel 34 in a helical manner in order to produce successive and even layers of the hose on the reel 34. In addition, when the hose 36 is being unwound from the reel 34, the guide arrangement 88 can be aligned with the guide 82 for facilitating guidance of the hose to the rollers 46, 48.

It has been found that the guide arrangement 86 also helps to reduce the amount of twist that is imparted to the hose as it is wound onto the reel 34 and, to a certain extent, as it is wound off the reel 34. The manner in which the hose 36 is evenly wound on the reel 34 and oriented in a substantially constant manner on the reel 34 contributes to the ability of the hose 36 to be easily driven into a conduit or the like. If little attention is given to the manner in which the hose is wound on the reel 34, the hose tends to coil on itself as it moves through the conduit. Thus, the hose contacts the wall of the conduit, thereby creating friction which can substantially impede the movement of the hose through the conduit. In the present invention, the guide arrangement 86 allows the hose 36 to be wound onto the reel 34 with a substantially constant orientation and in even and successive layers. Thus, the hose 36 tends to come off the reel 34 in a straighter manner than would otherwise be the case. The frictional resistance caused by the tendency of the hose to move through the conduit in a coiled manner is reduced and the hose is able to move through the conduit much more readily.

A housing 96 mounted on the transport vehicle 22 houses a fluid pump 98, an air compressor 100, and a drive engine 102. The drive engine 102 is connected to the hydraulic motors 44, 72 by suitable tubing 104, 106 in order to operate the hydraulic motors 44, 72. Of course, the housing 96 could be used to house whatever machinery or equipment is necessary for carrying out the particular functions of the apparatus 20. For example, it may not be necessary to provide a fluid pump and air compressor if the apparatus 20 is being used to drive or force a hose into a conduit for purposes other than dispensing some type of material into the conduit.

A tank 108 which contains the material for treating the conduit is also mounted on the transport vehicle 22. A cover 109 is positioned over an opening in the top of the tank 108. The opening permits the tank 108 to be filled with the material that is to be pumped through the hose 36 for treating the interior of a conduit. In a preferred embodiment, the tank 108 contains a liquid fumigant for killing roots and other plant life commonly found in conduits such as sewer systems. Depending upon the particular operations being performed by the apparatus 20, different materials and products may be stored in the tank 108 or the tank 108 may be eliminated.

As best seen in FIG. 2, suitable tubing 110 extends from the bottom of the tank 108 to connect the fumigant contained in the tank 108 with the fluid pump 98 and air compressor 100 for producing a foaming fumigant. A suitable valve or other arrangement known in the art can be provided to interconnect the tubing 110, the fluid pump 98, and the air compressor 100 to produce a foamed material. The foamed material is fed through tubing 112 which is connected to the end of the hose 36 as seen in FIG. 2.

A control panel 114 is positioned on the housing 96 for controlling the operation of the fluid pump 98, the air compressor 100, and the drive engine 102.

The apparatus according to a preferred embodiment of the present invention also includes a device for facilitating the guidance of the hose 36 into the conduit. Typically, the hose 36 must traverse one or more sharp turns or angled corners in order to reach the conduit that is to treated. For example, as seen in FIG. 1, the manhole or access opening through which the hose 36 must pass in order to reach the conduit or sewer line is arranged perpendicular to the conduit. Having to traverse such a sharp bend can significantly impede the movement of the hose 36 into the conduit. To help overcome the problems associated with moving the hose 36 through sharp bends, a guide pipe 116 may be utilized.

The guide pipe 116 can take the form of an elongated tubular member having an opening or slot 118 that extends along most of one side thereof. To maintain the rigidity of the guide pipe 116, several inches of the pipe 116 are left unslotted adjacent one end. Preferably, the size of the opening 118 extending along one side of the guide pipe 116 is greater than the diameter of the hose 36 in order to permit the hose to extend out of the open side 118 of the guide pipe. The guide pipe 116 can be positioned in the access opening or manhole at any desired angle in order to facilitate the guidance of the pipe 36 into the conduit. More than one guide pipe can be utilized to direct the hose into the conduit if it is necessary to negotiate the hose through more than one turn or bend prior to entering the conduit. Likewise, the circumstances may be such that a guide pipe 116 is not necessary.

As also seen in FIG. 1, the leading end 37 of the hose 36 can be provided with an arrangement for facilitating the movement of the hose 36 through the conduit and for preventing the forward movement of the hose 36 from becoming impeded as a result of obstacles and obstructions located in the conduit. As seen in more detail in FIG. 6, that arrangement includes a tube 120 having a threaded end that is secured to the leading end 37 of the hose 36. The tube 120 can be fabricated from any suitable material such as aluminum. Two hemispherically shaped wheels 122 are mounted for free rotation on a rod 124 which is connected to the forward end of the tube 120 by a coupling member 126. The two wheels 122 can, of course, be mounted for free rotation at the forward end of the tube 120, if desired. The tube 120 is also provided with a plurality of apertures or openings 128 through which the material being dispensed can flow. Of course, if the apparatus is being used for a purpose other than the dispensing of material, the tube 120 need not be provided with apertures 128.

Figure 6:
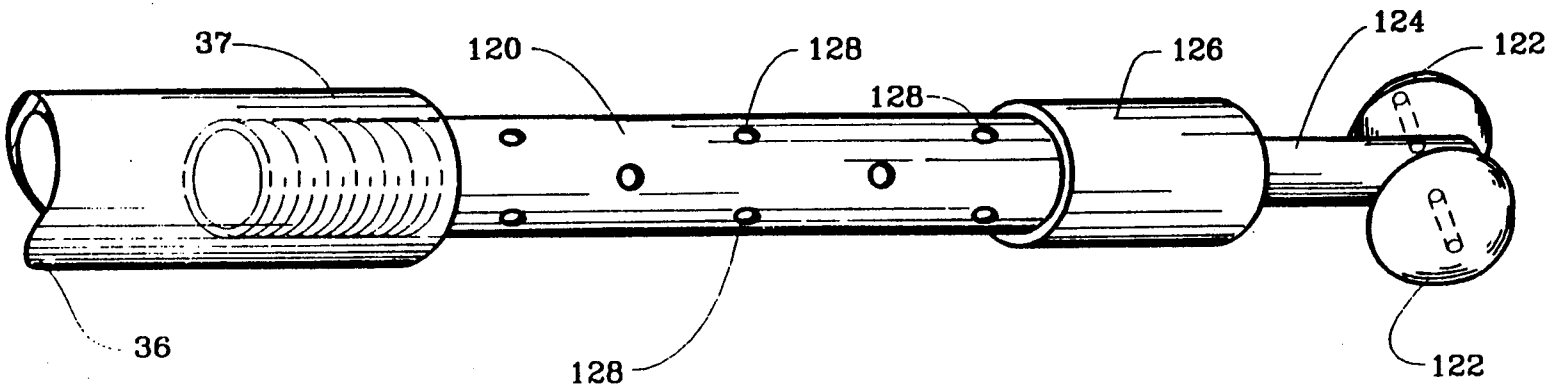
FIG. 6 is a perspective view of a portion of the leading end of the hose showing an attachment that is utilized in conjunction with the hose thrusting apparatus of the present invention.

The arrangement illustrated in FIG. 6, which is attached to the leading end 37 of the hose 36 is particularly advantageous in overcoming the disadvantages and drawbacks which normally arise when the leading end of the hose 36 confronts an obstruction or obstacle in the conduit or pipe being treated. The ability of the leading end of the hose 36 to roll along the inner surface of the conduit allows the hose 36 to push through roots and collected debris on the interior of the conduit and enables the hose 36 to bounce off essentially immovable obstacles and obstructions in the conduit such as offset joints, cracks in the conduit and other partial obstructions. As a result, the hose 36 can be propelled through conduits without the typical kinking or bowing of the hose that normally takes place when a flexible or semi-rigid hose encounters an obstruction or obstacle. Moreover, the friction that is normally produced as a result of the hose being pushed along the inner surface of the conduit can be substantially reduced.

Situations may occasionally arise when an obstruction or obstacle in the conduit is so large that the wheels 122 cannot bounce off the obstruction or obstacle. Thus, it may be desirable to incorporate a feature into the apparatus that will permit the detection of such a situation. For example, the apparatus could be provided with some type of sensor for sensing when the forward movement of the hose has slowed or stopped. Alternatively, a slip clutch could be incorporated into the drive motor 72 for automatically ceasing operation of the motor 72 when a particular amount of resistance force is encountered.

Figure 7:
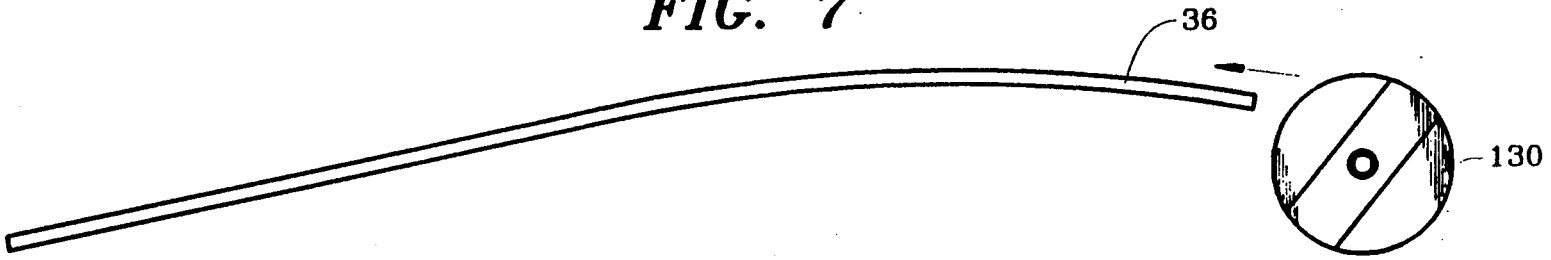
FIG. 7 is a schematic illustration of the hose being unwound from a supply reel.

As schematically illustrated in FIG. 7, the hose 36 which is used in conjunction with the apparatus of the present invention is supplied on a supply reel 130. The hose 36 is preferably a semi-rigid hose.

Figure 8:
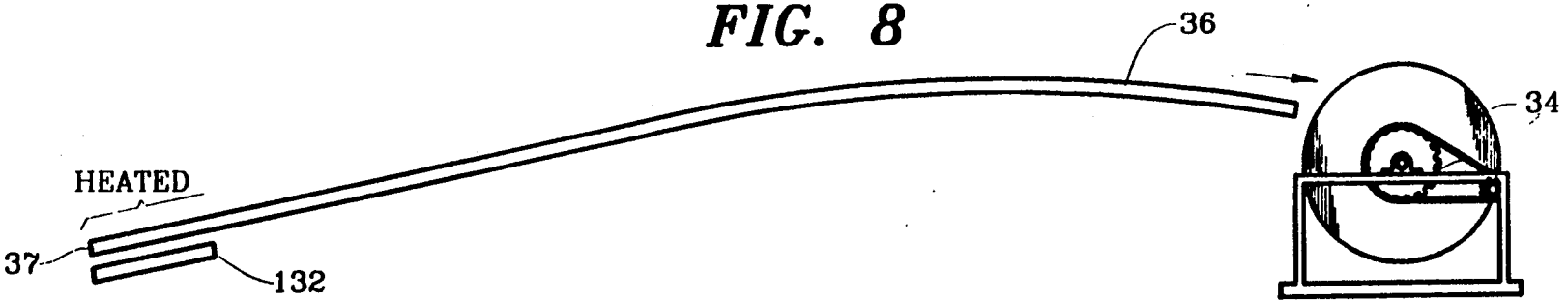
FIG. 8 is a schematic illustration of the hose having a leading end treated and being wound on the reel of the hose thrusting apparatus.

As depicted in FIG. 8, the hose 36 from the supply reel 130 is then fed onto the reel 34 which is mounted on the transport vehicle 22. It has been found that the hose 36 is easier to handle insofar as pushing the hose 36 into and along the conduit if the twist in the hose 36 is kept to a minimum. Thus, it is advantageous to wind the hose 36 onto the reel 34 in a manner that will prevent the hose 36 from twisting.

The characteristics and nature of the semi-rigid hose 36 are such that the hose 36 develops a particular set or memory as a result of the initial hose-manufacturing process and due to the fact that the hose 36 is wound on a reel while still hot from the manufacturing process. Consequently, the hose tends to coil as it is unwound from the reel 34 during operation of the apparatus 20. As was pointed out above, the tendency of the hose 36, and particularly the leading end 37 of the hose 36, to coil as it is unwound from the reel 34 can present significant difficulties with respect to pushing the hose through a conduit such as a sewer line.

It has been discovered, however, that the foregoing problems can be alleviated, to a certain extent, by thermally heating or otherwise treating the hose 36 in order to remove the coiled set and impart a different memory or set, preferably non-coiled and substantially straight, to the hose 36. Surprisingly, it has been found that heating only the first several feet of the hose 36 adjacent the leading end 37 of the hose 36 is sufficient to alleviate many of the drawbacks commonly associated with the coiled set of the entire hose 36, at least for purposes of driving the hose down a conduit by pushing. At least two feet of the hose 36, and preferably slightly more, should be heated.

One of the advantages of heating the leading portion of the semi-rigid hose to remove the coiled set is that the hose still possesses the desirable characteristics of a semi-rigid hose while eliminating the undesirable attributes associated with the coiled set of the hose. For example, the leading end of the hose is still able to bend and flex around corners even though the coiled set has been removed.

As seen in FIG. 8, the leading end of the hose 36 can be heated through use of a suitable heating arrangement 132 while the hose is being wound onto the reel 34 from the supply reel 130. Alternatively, the leading end of the hose 36 can be heated at some other time such as when the hose is initially being unwound from the reel 34. At any rate, the heat treatment should be applied to a portion of the hose adjacent the leading end prior to entry of the hose into the conduit. As a general rule, the leading end portion of the hose 36 need only be heat treated once in order to remove the coiled memory and impart a memory that is more suitable for being pushed through the conduit.

Various types of heating arrangements could be employed to heat a portion of the hose adjacent the leading end. The selection of a particular heating device may depend upon the particular properties of the material from which the hose is manufactured. Clearly, the hose should not be heated to such an extent that it melts. On the other hand, a sufficient amount of heat must be applied to the hose to remove the coiled set or memory. Those considerations as well as others should be taken into account when selecting an appropriate heating device. Thus, it is to be understood that any suitable arrangement could be employed to remove the "coiled memory" from the leading end of the hose and to impart the "straight memory" thereto.

The semi-rigid hose or pipe used in the apparatus of the present invention is preferably fabricated from polyethylene having a modulus of elasticity of approximately 0.11 million psi at 75° F. and 0.20 million psi at 32° F. Compared to some cleaning devices which utilize steel pipe having a modulus of elasticity of approximately 28 million psi, the pipe of the present invention is much easier to work with. It has been found that the semi-rigid pipe of the present invention produces very good results.

The apparatus according to the present invention may be operated in the following manner. Assuming the hose 36 has already been heated in the manner described above, the leading end of the hose 36 is led through the guide arrangement 86, through the guide 82, and between the two rollers 46, 48. The hose 36 can then be directed through the guide 84 and into the guide pipe 118 (if a guide pipe is being used). At some point prior to when the leading end of the hose is inserted into the conduit, the tube 120 and attached wheels 122 should be connected to the leading end 37 of the hose 36.

The motor 72 is then turned on to drive the lower roller 48 in the counter-clockwise direction as seen in FIG. 1. The driving force of the lower roller 48 causes the hose to be pushed in the forward direction along the conduit. The wheels 122 help ensure that the hose 36 moves smoothly along the conduit and that the forward movement of the hose does not become impeded when the hose 36 encounters obstructions and obstacles in the conduit. Preferably, the hose is mechanically driven downstream along the conduit until the leading end 37 of the hose 36 reaches the next manhole or access opening to the conduit. At that point, the motor 72 may be turned off while the motor 44 is turned on. The motor 44 will cause the reel 34 to rotate in a direction (clockwise as seen in FIG. 1) necessary for withdrawing the hose from the conduit and winding the hose on the reel 34. Simultaneously, foaming fumigant is pumped through the hose and dispensed in the conduit by way of the apertures 128 in the tube 120. In that way, the interior of the conduit is treated as the hose is withdrawn.

It is to be understood that the foregoing description is only meant to set forth one possible use and manner of operation of the apparatus of the present invention. For example, the apparatus according to the present invention could be utilized for purposes other than dispensing foaming fumigant for killing roots and other plant growth in sewer lines. The apparatus could be employed to tag lines, to apply coatings such as paints and corrosion retardants to the inner surface of a conduit, to apply grease removal agents and to carry out other treatments in a conduit. Also, the apparatus could be used to feed a new hose into an existing but deteriorating pipe, for example a gas line. In such an alternative, it would not be necessary to utilize the reel 34 as a means for rewinding the hose because the hose would be cut rather than rewound.

Also, the motors 44, 72 could be operated in conjunction with one another rather than separately, if desired.

The apparatus and method according to the present invention are advantageous in that the manual labor usually required to push the hose through the conduit is substantially eliminated. The hose can be pushed through the conduit much more quickly and much more efficiently than known manual methods. In addition, the treatment material can be accurately dispensed in the conduit because the rotatably driven reel can be driven at a constant speed for ensuring that the hose is withdrawn from the conduit at a substantially constant rate. Moreover, the problems which typically arise due to obstructions and obstacles in the conduit are of little concern when utilizing the apparatus of the present invention. Further yet, in the apparatus of the present invention, sharp bends and turns in the access openings that lead to the conduit do not present difficulties as the hose is fed toward the conduit.

The principles, preferred embodiments, and modes of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others without departing from the spirit of the present invention. Accordingly, it is expressly intended that all such variations, modifications, changes, and equivalents which fall within the spirit and scope of the present invention as defined in the claims, be embraced thereby.

What is claimed is:

1. An apparatus for moving a hose along a conduit and for withdrawing the hose from the conduit, comprising a transport vehicle;

a rotatable reel mounted on the transport vehicle;

a semi-rigid hose wound on the rotatable reel, said semi-rigid hose having a leading end portion whose plastic memory characteristics are different from the plastic memory characteristics of a remaining portion thereof;

powered driving means mounted on the transport vehicle for drawing the semi-rigid hose off the rotatable reel and for driving the semi-rigid hose in a forward direction into and along a conduit;

rotating means connected to said rotatable reel for rotating said rotatable reel in a direction necessary for causing the semi-rigid hose to be withdrawn from the conduit and wound on the rotatable reel; and rolling means connected to a leading end of the semi-rigid hose for freely rolling along an inner surface of the conduit to help prevent the movement of the semi-rigid hose through the conduit from being impeded as a result of obstacles and obstructions in the conduit.

2. The apparatus according to claim 1, wherein said rotatable reel includes a shaft around which the rotatable reel rotates, said shaft having a sprocket wheel connected to one end thereof, said rotating means for rotating the reel including a motor having a drive shaft which is connected to said sprocket wheel by a chain.

3. The apparatus according to claim 1, including a guide means adapted to be positioned in an access opening to the conduit for guiding the semi-rigid hose into the conduit.

4. The apparatus according to claim 3, wherein said guide means includes a pipe having a slot that extends along a substantial portion of the length thereof, said slot extending completely to one end of the pipe and terminating at a point spaced from the opposite end thereof, the size of the slot being greater than the diameter of the semi-rigid hose.

5. The apparatus according to claim 1, wherein said rolling means includes an apertured tube connected to the leading end of the semi-rigid hose and two wheels connected to the apertured tube.

6. The apparatus according to claim 1, wherein said powered driving means includes two spaced apart and opposing rollers between which said semi-rigid hose passes and means for rotatably driving at least one of the rollers.

7. The apparatus according to claim 6, including means for adjusting the position of one of the rollers relative to the other roller to vary the spacing between the two rollers and to vary the force applied to the semi-rigid hose.

8. The apparatus according to claim 1, wherein said transport vehicle includes a support frame, and including a first guide positioned upstream from the powered driving means with respect to the forward direction of movement of the semi-rigid hose and mounted on the frame structure for guiding the semi-rigid hose toward the powered driving means as the semi-rigid hose moves in the forward direction, and a second guide positioned downstream from the powered driving means with respect to the direction of forward movement of the semi-rigid hose and mounted on the support frame for guiding the semi-rigid hose toward the conduit as the semi-rigid hose moves in the forward direction.

9. The apparatus according to claim 1, wherein said transport vehicle includes a support frame, and including means slidably mounted on the support frame and positioned between the rotatable reel and the powered driving means for allowing the semi-rigid hose to be helically wound on the rotatable reel in successive layers.

10. The apparatus according to claim 1, wherein said powered driving means, said rotating means and said rolling means are separate from one another.

11. The apparatus according to claim 1, wherein said powered driving means includes a rotatable engaging member and means connected to said engaging member for rotating the engaging member, said rotatable engaging member being positioned to engage the semi-rigid hose at a point downstream from the rotatable reel with respect to the forward direction of movement of the semi-rigid hose.

12. The apparatus according to claim 1, wherein rolling movement is imparted to said rolling means by said powered driving means.

13. An apparatus for pushing a hose along a conduit, comprising:

a rotatable reel;

a hose wound on the rotatable reel; and powered driving means for driving the hose off the rotatable reel and for driving the hose in a forward direction into and along a conduit, said powered driving means being positioned to engage the hose at a point downstream from the rotatable reel with respect to the forward direction of movement of the hose.

14. The apparatus according to claim 13, wherein said powered driving means includes two spaced apart and opposing rollers between which the hose passes and means for rotatable driving at least one of the two rollers.

15. The apparatus according to claim 13, wherein said rotatable reel is mounted on a transport vehicle having a support frame, and including means slidably mounted on the support frame and positioned between the rotatable reel and the powered driving means for allowing the hose to be helically wound on the rotatable reel in successive layers.

16. The apparatus according to claim 13, including an apertured tube connected to a leading end of the hose and two wheels connected to the apertured tube for allowing the leading end of the hose to move through the conduit without being impeded by obstacles and obstructions in the conduit.

17. The apparatus according to claim 13, wherein a leading end portion of the hose possesses plastic memory characteristics of a substantially straight nature and a remaining portion of the hose possesses plastic memory characteristics of a curved nature so that the plastic memory characteristics of the leading end portion are different from the plastic memory characteristics of the remaining portion.

18. The apparatus according to claim 13, including a guide pipe which is adapted to be positioned in an access opening to the conduit, said guide pipe having a slot that extends along less than the entire length thereof.

19. The apparatus according to claim 13, wherein said hose is semi-rigid and has a modulus of elasticity of about 0.11 million psi at 75° F.

20. The apparatus according to claim 13, including a power source connected to said rotatable reel for rotatably driving the rotatable reel in a direction necessary for withdrawing the hose from the conduit and winding the hose on the rotatable reel.

21. The apparatus according to claim 13, wherein said powered driving means includes a rotatable engaging member and means connected to said engaging member for rotating the engaging member, said rotatable engaging member being positioned to engage the hose at a point downstream from the rotatable reel with respect to the forward direction of movement of the hose.

22. An apparatus for use in treating an interior of a conduit, comprising:

a rotatable shaft;

a semi-rigid hose wound on said reel;

powered driving means for drawing the semi-rigid hose off the rotatable reel and for driving the semi-rigid hose in a forward direction into and along a conduit;

rolling means connected to a leading end of the semi-rigid hose for freely rolling along an interior surface of the conduit to help prevent the movement of the hose through the conduit from being impeded as a result of obstacles and obstructions in the conduit;

a container containing material for treating the interior of the conduit; and means for pumping the material in the container through the semi-rigid hose to treat the interior of the conduit with said material.

23. The apparatus according to claim 22, wherein a leading end portion of the semi-rigid hose possesses plastic memory characteristics of a substantially straight nature and a remaining portion of the semi-rigid hose possesses plastic memory characteristics of a curved nature so that the plastic memory characteristics of the leading end portion are different from the plastic memory characteristics of the remaining portion.

24. The apparatus according to claim 22, wherein said rotatable reel is mounted on a transport vehicle having a support frame, and including means slidably mounted on the support frame and positioned between the rotatable reel and the powered driving means for helically winding the semi-rigid hose on the rotatable reel in successive and even layers.

25. The apparatus according to claim 22, wherein said powered driving means includes two spaced apart and opposing pneumatic rollers between which said semi-rigid hose passes and means for rotatably driving at least one of said two rollers.

26. The apparatus according to claim 25, including means for adjusting the position of a least one of the rollers relative to the other roller to vary the spacing between the two rollers and to vary the force applied to the semi-rigid hose.

27. The apparatus according to claim 22, including a guide pipe adapted to be positioned in an access opening to the conduit to help guide the semi-rigid hose into the conduit, said guide pipe having a slot that extends along less than the entire length thereof, the width of said slot being greater than the diameter of the semi-rigid hose.

28. The apparatus according to claim 22, wherein said material is a fumigant, and including a fluid pump and an air compressor for foaming the fumigant, and wherein said rolling means for permitting the leading end of the hose to roll along the interior surface of the conduit includes an apertured tube connected to the leading end of the semi-rigid hose and two wheels connected to the apertured tube.

29. The apparatus according to claim 22, wherein said powered driving means is positioned to engage the semi-rigid hose at a point downstream from the rotatable reel with respect to the forward direction of movement of the semi-rigid hose.

30. The apparatus according to claim 22, wherein rolling movement is imparted to said rolling means by said powered driving means.

* * * * *

UNITED STATES PATENT AND TRADEMARK OFFICE

CERTIFICATE OF CORRECTION

PATENT NO. : 5,139,751

DATED : August 18, 1992

INVENTOR(S) : William A. Mansfield, Frank O. Martinez and Steven E. Richardson

It is certified that error appears in the above-identified patent and that said Letters Patent is hereby corrected as shown below:

Column 4, line 26, delete "ma" and insert --may-- therefor;

Column 4, line 39, delete "4" and insert --42-- therefor;

Column 4, line 53, delete "0" and insert --or-- therefor;

Column 11, line 30, before the word "reel" insert --rotatable-- therefor;

Column 12, line 38, delete "rotatable" and insert --rotatably-- therefor;

Column 13, line 16, delete "shaft" and insert --reel-- therefor;

Signed and Sealed this

Thirtieth Day of November, 1993

*Attest:*

Bruce Lehman

BRUCE LEHMAN

*Attesting Officer*

*Commissioner of Patents and Trademarks*